US007523583B2

(12) United States Patent
Cheng

(10) Patent No.: US 7,523,583 B2
(45) Date of Patent: Apr. 28, 2009

(54) GUN SYSTEM AND ACCESSORY THEREOF

(75) Inventor: Daniel Cheng, Sijhih (TW)

(73) Assignee: Quarton Inc. (TW)

( * ) Notice: Subject to any disclaimer, the term of this patent is extended or adjusted under 35 U.S.C. 154(b) by 280 days.

(21) Appl. No.: 11/483,733

(22) Filed: Jul. 10, 2006

(65) Prior Publication Data

US 2007/0193103 A1 Aug. 23, 2007

(30) Foreign Application Priority Data

Jan. 20, 2006 (TW) ..... 95102187 A

(51) Int. Cl.
*F41G 1/00* (2006.01)

(52) U.S. Cl. ..... 42/146; 42/114; 362/110

(58) Field of Classification Search ..... 42/146, 42/90, 114, 115, 124–127; 362/110, 113, 362/114; 403/322.1, 322.4, 325, 330
See application file for complete search history.

(56) References Cited

U.S. PATENT DOCUMENTS 1,892,141 A * 12/1932 Garand ..... 89/14.1
3,225,653 A * 12/1965 Packard ..... 89/1.4
3,985,060 A * 10/1976 Conley ..... 89/34
5,430,967 A * 7/1995 Woodman et al. ..... 42/146
6,185,854 B1 * 2/2001 Solinsky et al. ..... 42/111
6,574,901 B1 * 6/2003 Solinsky et al. ..... 42/146
6,874,269 B2 4/2005 Chen et al.
7,260,912 B2 * 8/2007 Liu ..... 42/127
7,305,790 B2 * 12/2007 Kay ..... 42/146
7,310,903 B2 * 12/2007 Kim ..... 42/114
2004/0068913 A1 * 4/2004 Solinsky et al. ..... 42/146
2005/0246936 A1 * 11/2005 Kay ..... 42/146
2005/0257415 A1 * 11/2005 Solinsky et al. ..... 42/146

* cited by examiner

*Primary Examiner*—Troy Chambers
*Assistant Examiner*—Jonathan C Weber
(74) *Attorney, Agent, or Firm*—Raymond Sun

(57) ABSTRACT

A gun accessory includes a main body having an upper surface having two sides, a first side wall and a second side wall extending upwardly from each of the two sides, first and second slide members provided on the first and second side walls, respectively, and a first locating hole provided adjacent the first side wall. The accessory also includes a first locating bar pivotably coupled to the first locating hole and having a first baffle and a first press plate, and a first elastic element provided between the first press plate and the main body to pivot the first press plate with respect to the main body, and in turn drive the first baffle to protrude above the upper surface of the main body.

7 Claims, 4 Drawing Sheets

GUN SYSTEM AND ACCESSORY THEREOF

BACKGROUND OF THE INVENTION

1. Field of the Invention

The present invention relates to a gun system and its accessory, and in particular, to a gun system having an accessory that can be easily installed and removed.

2. Description of the Related Art

With the advance of technology, there are a variety of gun accessories developed for the market for use as auxiliary devices in the use of guns. Laser sights, for example, have been installed in guns to provide better aim at targets. In addition, light sources have been installed in guns to assist the shooter in aiming in a dim or dark surrounding.

Conventional gun accessories are usually secured in a gun by screws, making it inconvenient to install and remove these accessories. Attempts have been made to improve the assembly and disassembly of gun accessories.

For example, U.S. Pat. No. 6,185,854 discloses an auxiliary device for a gun to facilitate convenient assembly and disassembly. When the gun auxiliary device described in this patent is being removed, the bar that provides the locking must be pressed downward to overcome a spring force. However, this downward force can be inconvenient and difficult for the user to apply.

As another example, U.S. Pat. No. 6,874,269 discloses several auxiliary devices for use with guns which attempt to provide better a direction and application point for the applied force. However, the locking mechanism is achieved by locking into a locating groove through both sides of the gun, but the transverse component of the recoil resulting from shooting tends to affect the stability of this locking operation.

Consequently, there still remains a need to provide a gun accessory which can be conveniently installed and removed, while still providing stability in operation.

SUMMARY OF THE INVENTION

It is an object of the present invention to provide a gun accessory which can be conveniently installed and removed, while still providing stability in operation.

The objectives of the present invention can be accomplished by providing a gun accessory that includes a main body having an upper surface having two sides, a first side wall and a second side wall extending upwardly from each of the two sides, first and second slide members provided on the first and second side walls, respectively, and a first locating hole provided adjacent the first side wall. The accessory also includes a first locating bar pivotably coupled to the first locating hole and having a first baffle and a first press plate, and a first elastic element provided between the first press plate and the main body to pivot the first press plate with respect to the main body, and in turn drive the first baffle to protrude above the upper surface of the main body.

DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Figure 1:
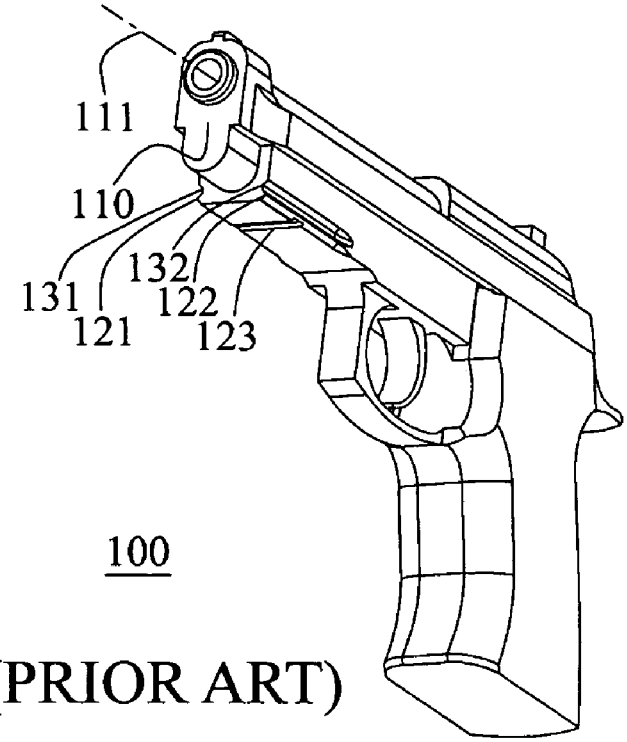
FIG. 1 (PRIOR ART)
FIG. 1 is a perspective view of a conventional hand gun.

FIG. 1 illustrates a conventional hand gun 100 that can be used with the accessories of the present invention. The gun 100 has slide rails 121 and 122 provided on the opposite lower sides of the barrel 110, and are parallel to the axis 111 of the barrel 110. A locating groove 123 is provided at the bottom of the barrel 110, and is transverse to the axis 111 of the barrel 110.

Figure 2:
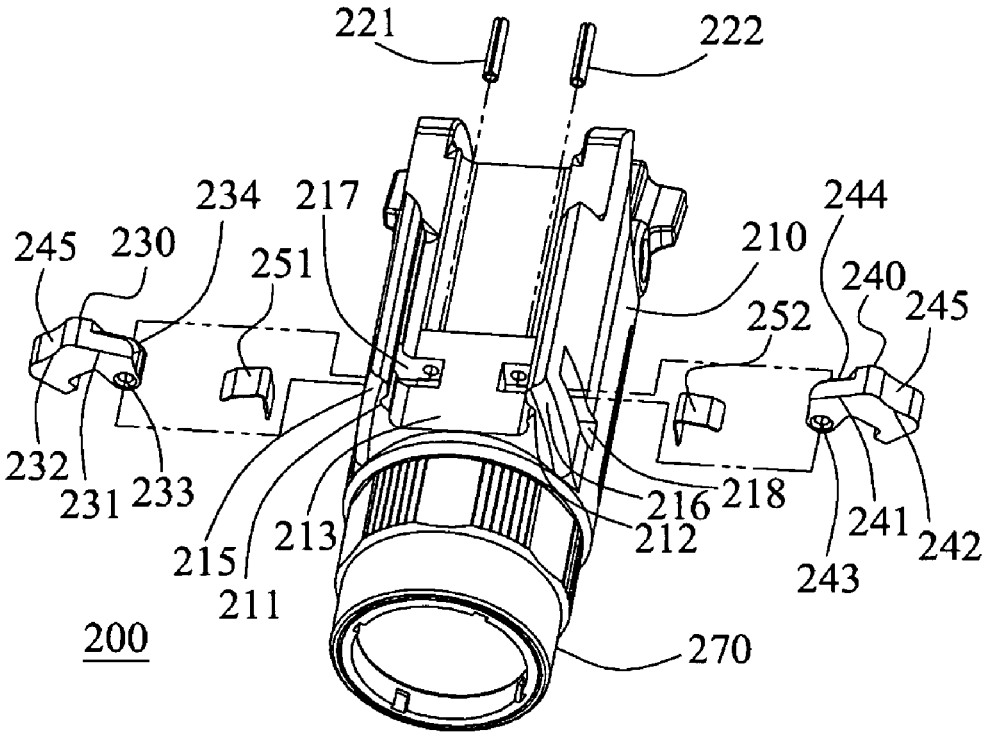
FIG. 2 is a partial exploded perspective view of a gun accessory according to a first embodiment of the present invention.
Figure 3:
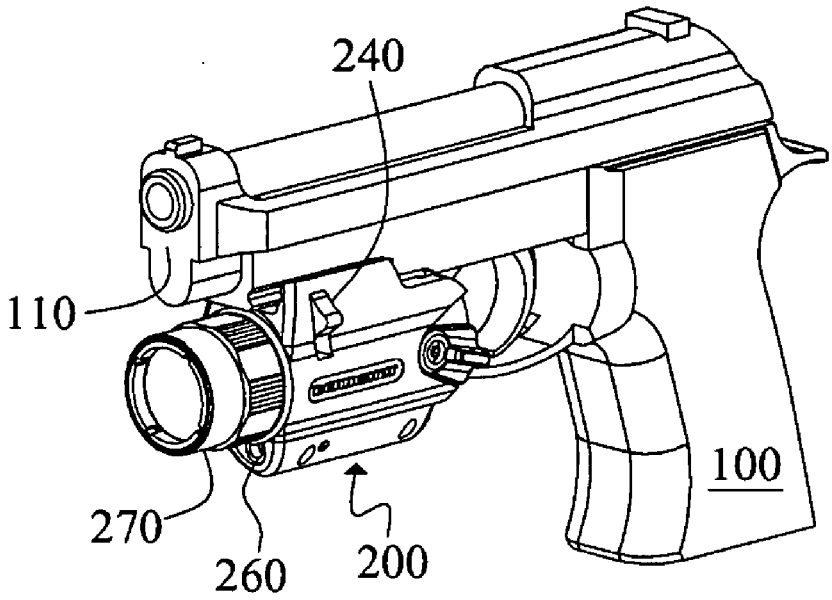
FIG. 3 is a perspective assembly view of the gun accessory of FIG. 2 shown in use with the hand gun in FIG. 1.
Figure 4:
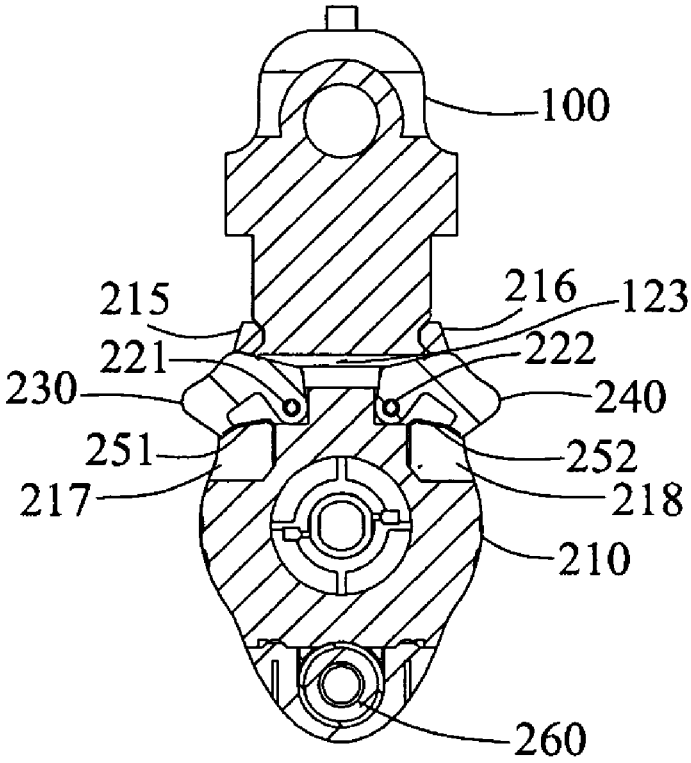
FIG. 4 is cross-sectional view of the gun system of FIG. 3.

Referring now to FIGS. 2 to 4, a gun accessory 200 according to one embodiment of the present invention has a main body 210, locating pins 221 and 222, locating bars 230 and 240, elastic elements 251 and 252 (e.g., spring plates), a laser sight 260, and a light source 270 (e.g., a flash light). The laser sight 260 is disposed on the bottom of the main body 210, and the light source 270 is screwed and secured to the front of the main body 210. The light source 270 functions to assist users in aiming at targets, or to provide lighting under dim or dark surroundings.

As shown in FIGS. 2-4, each of the two opposite sides on the upper surface 213 of the main body 210 is provided with a respective side wall 215 and 216 that extends upwards to form a somewhat U-shaped structure. Each side wall 215 and 216 is provided with a respective inwardly-facing slide groove 211 and 212, respectively, that is adapted to correspond to the slide rails 121 and 122, respectively, provided on opposite sides of the hand gun 100 shown in FIG. 1, such that the gun accessory 200 can be slidably connected with the gun 100 (as shown in FIG. 3). Also, the size and shape of the slide grooves 211 and 212 are sized and configured to be complementary to those of the slide rails 121 and 122, respectively, of the hand gun 100.

As an alternative, it is possible to provide slide rails (not shown) on the main body 210 that can be slidably received by corresponding slide grooves 131 and 132 provided on opposite sides of the gun 100.

In addition, the side walls 215 and 216 are provided with locating holes 217 and 218, respectively. The locating hole 217 is adapted to receive a portion of the locating pin 221, the locating bar 230, and the spring plate 251, and the locating hole 218 is adapted to receive a portion of the locating pin 222, the locating bar 240, and the spring plate 252. The locating pins 221 and 222 extend through bores in the main body 210 and are secured inside the locating holes 217 and 218, respectively, and each locating pin 221 and 222 provides a rotating axis that extends in the same direction as the slide grooves 211 or 212, respectively.

The locating bar 230 has a generally L-shaped configuration and includes a baffle 231, a press plate 232, and a through hole 233. The locating pin 221 passes through the through hole 233 to secure the locating bar 230 in the locating hole 217 such that the locating bar 230 can utilize the locating pin 221 as a rotating axis and thereby pivotably connect the locating bar 230 to the main body 210. The locating bar 240 also has a generally L-shaped configuration and includes a baffle 241, a press plate 242, and a through hole 243. The locating pin 222 passes through the through hole 243 to secure the locating bar 240 in the locating hole 218 such that the locating bar 240 can utilize the locating pin 222 as a rotating axis and pivotably connect the locating bar 240 to the main body 210. The spring plate 251 is disposed between the press plate 232 and the main body 210, and the spring plate 252 is disposed between the press plate 242 and the main body 210.

To enable the gun accessory 200 to easily and conveniently slide into the hand gun 100, the baffles 231 and 241 are provided with bevel planes 234 and 244, respectively. When the slide grooves 211 and 212 of the gun accessory 200 are slid into the barrel of the hand gun 100 through the slide rails 121 and 122, respectively, the bevel planes 234 and 244 of the baffles 231 and 241 contact against the barrel of the hand gun 100. The barrel continues to slide upwardly along the bevel planes 234, 244, thereby biasing the baffles 231 and 241 downwardly against the normal bias of the spring plates 251 and 252, respectively. From the orientation shown in FIG. 4, the locating bar 230 is pivoted in a counterclockwise direction about the pivot axis 221, and the locating bar 240 is pivoted in a clockwise direction about the pivot axis 222. The slide grooves 211 and 212 of the gun accessory 200 then continue to slide along the slide rails 121 and 122 until the locating bars 230 and 240 reach the locating groove 123 of the hand gun 100, at which time the spring forces of the spring plates 251 and 252 will naturally bias or push the press plates 232 and 242, respectively, away from the main body 210 (i.e., towards the locating groove 123) and in turn push the baffles 231 and 241, respectively, such that the baffles 231 and 241 protrude above the plane of the upper surface 213 of the main body 210 to be locked into the locating groove 123 of the hand gun 100. From the orientation shown in FIG. 4, the locating bar 230 now is pivoted in a clockwise direction about the pivot axis 221, and the locating bar 240 is pivoted in a counterclockwise direction about the pivot axis 222. Thus, the accessory 200 can be easily and quickly secured to the hand gun 100 during operation of the hand gun 100.

To remove the gun accessory 200 from the hand gun 100, a user can use his or her fingers to press the press plates 232 and 242 on the respective sides of the main body 210 to overcome the spring force of the spring plates 251 and 252, such that the press plates 232 and 242 push the baffles 231 and 241 downward to disengage the locating groove 123 of the hand gun 100. The gun accessory 200 can then be pushed away from the hand gun 100 along the slide rails 121 and 122 so as to remove the gun accessory 200 from the hand gun 100. In addition, the press plates 232 and 242 are provided with respective slide-proof grooves 245 to prevent the user's fingers from sliding away from the press plates 232 and 242 when the user presses the press plates 232 and 242.

Figure 5:
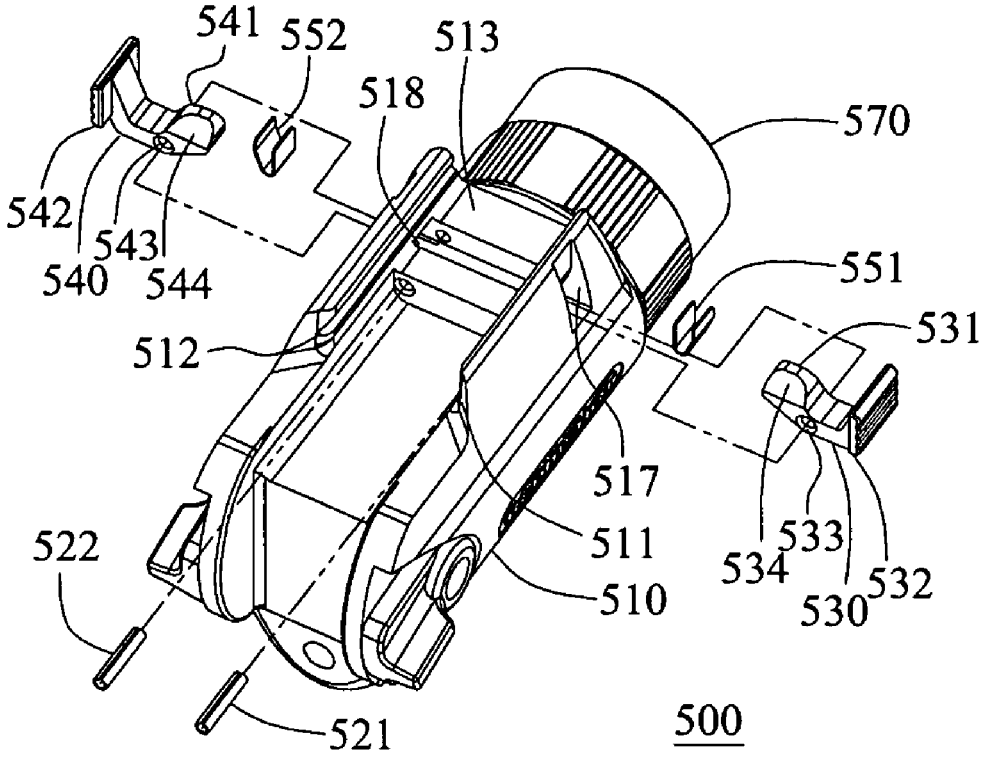
FIG. 5 is a partial exploded perspective view of the gun accessory according to a second embodiment of the present invention.
Figure 6:
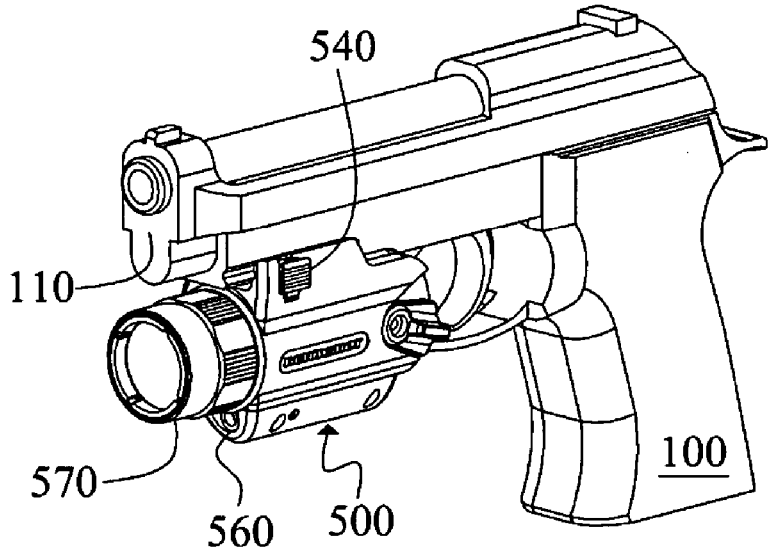
FIG. 6 is a perspective assembly view of the gun accessory of FIG. 5 shown in use with the hand gun in FIG. 1.
Figure 7:
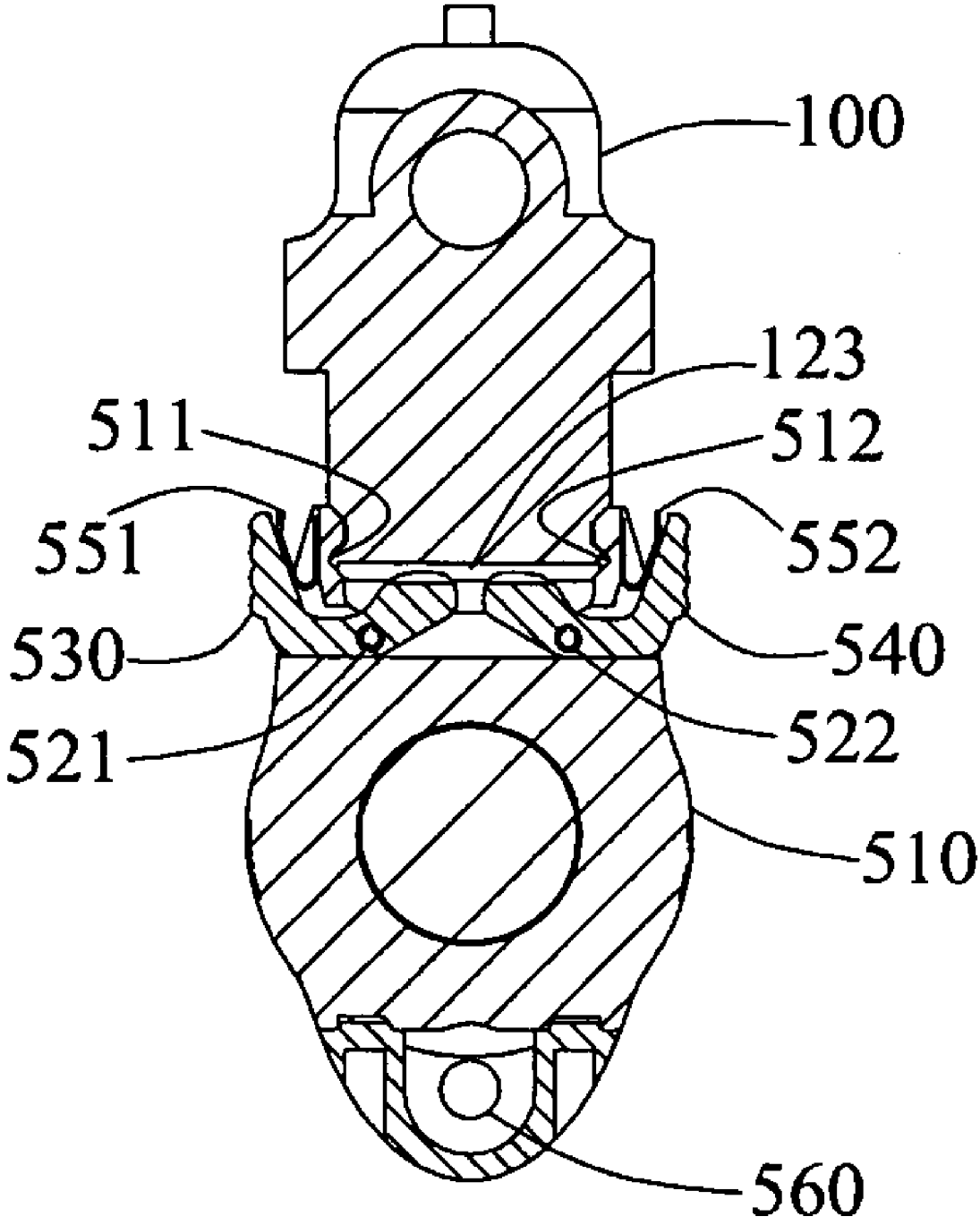
FIG. 7 is cross-sectional view of the gun system of FIG. 6.

FIGS. 5-7 illustrate a second embodiment of a gun accessory 500 which is similar to the accessory 200 in FIGS. 2-4. As a result, the same numeral designations shall be used in both embodiments to designate the same element, except that the elements in FIGS. 2-4 shall begin with a "2" and the elements in FIGS. 5-7 shall begin with a "5".

The accessory 500 includes a main body 510, locating pins 521 and 522, locating bars 530 and 540, elastic elements 551 and 552 (e.g., spring plates), a laser sight 560, and a light source 570 (e.g., a flash light). When compared with the gun accessory 200 shown in FIGS. 2-4, the accessory 500 is different in that the locating bars 530 and 540, and the locations of the locating holes 517 and 518 of the main body 510, are different.

In the accessory 200 of FIGS. 2-4, the through holes 233 and 243 are disposed at the end of the locating bars 230 and 240 away from the press plates 232 and 242, the baffle 231 is disposed between the through hole 233 and the press plate 232, and the baffle 241 is disposed between the through hole 243 and the press plate 242. Consequently, the protrusions of the baffles 231 and 241, as well as the bevel planes 234 and 244, are positioned on the exterior of the L-shape structure, such that each locating bar 230 and 240 is oriented in an inverted L shape (when viewed from the front of the light source 270 in FIG. 4) into the respective locating hole 217 and 218 of the main body 210.

In contrast, the through hole 533 of the locating bar 530 in FIGS. 5-7 is disposed between the baffle 531 and the press plate 532, and similarly, the through hole 543 of the locating bar 540 is also disposed between the baffle 541 and the press plate 542. In addition, the baffles 531 and 541 are disposed at the end of locating bars 530 and 540 away from the press plates 532 and 542, respectively. Consequently, the protrusions of the baffles 531 and 541, as well as the bevel planes 534 and 544, are positioned on the interior of the L-shape structure, such that the locating bars 530 and 540 are oriented in a normal L shape (when viewed from the front of the light source 570 in FIG. 7) into the respective locating hole 517 and 518 of the main body 510.

To enable the gun accessory 500 to easily and conveniently slide into the hand gun 100, the baffles 531 and 541 are provided with bevel planes 534 and 544, respectively. When the slide grooves 511 and 512 of the gun accessory 500 are slid into the hand gun 100 through the slide rails 121 and 122, respectively, the bevel planes 534 and 544 of the baffles 531 and 541 contact against the barrel of the hand gun 100. The barrel continues to slide upwardly along the bevel planes 534, 544, thereby biasing the baffles 531 and 541 downwardly against the normal bias of the spring plates 551 and 552, respectively. From the orientation shown in FIG. 7, the locating bar 530 is pivoted in a clockwise direction about the pivot axis 521, and the locating bar 540 is pivoted in a counterclockwise direction about the pivot axis 522. The slide grooves 511 and 512 of the gun accessory 500 then continue to slide along the slide rails 121 and 122 until the locating bars 530 and 540 reach the locating groove 123 of the hand gun 100, at which time the spring forces of the spring plates 551 and 552 will naturally bias or push the press plates 532 and 542, respectively, away from the barrel of the gun 100 and in turn push the baffles 531 and 541, respectively, such that the baffles 531 and 541 protrude above the plane of the upper surface 513 of the main body 510 to be locked into the locating groove 123 of the hand gun 100. From the orientation shown in FIG. 7, the locating bar 530 now is pivoted in a counterclockwise direction about the pivot axis 521, and the locating bar 540 is pivoted in a clockwise direction about the pivot axis 522.

To remove the gun accessory 500 from the hand gun 100, a user can use his or her fingers to press the press plates 532 and 542 on the respective sides of the main body 510 to overcome the spring force of the spring plates 551 and 552, such that the press plates 532 and 542 push the baffles 531 and 541 downward to disengage the locating groove 123 of the hand gun 100. The gun accessory 500 can then be pushed away from the hand gun 100 along the slide rails 121 and 122 so as to remove the gun accessory 500 from the hand gun 100.

As a result, the gun accessories 200 and 500 can be conveniently installed by a simple sliding action, and conveniently removed by simply pressing the press plates 232, 242, 532, 542 and then sliding the accessory 200, 500 off the barrel 110 of the gun 100. In addition, the mechanisms that secure the accessory 200, 500 to the gun 100 provide for enhanced operating stability.

While the description above refers to particular embodiments of the present invention, it will be understood that many modifications may be made without departing from the spirit thereof.

What is claimed is:

1. A gun system, comprising:

i. a gun provided with a barrel having opposite lower sides that are provided with first and second means for sliding that are parallel to the longitudinal axis of the barrel, and a locating groove that is transverse to the longitudinal axis of the barrel; and ii. a gun accessory having:

a main body having an upper surface having two sides, a first side wall and a second side wall extending upwardly from each of the two sides of the main body, third and fourth complementary means for sliding provided on the first and second side walls, respectively, that are removably coupled to the first and second means for sliding, respectively, the main body further including a first locating hole provided adjacent the first side wall and a second locating hole provided adjacent the second side wall;

a first locating bar pivotably coupled to the first locating hole by a first locating pin that extends parallel to the longitudinal axis of the barrel, the first locating bar having a first baffle and a first press plate;

a second locating bar pivotably coupled into the second locating hole by a second locating pin that extends parallel to the longitudinal axis of the barrel, the second locating bar having a second baffle and a second press plate;

a first elastic element provided between the first press plate and the main body to pivot the first press plate with respect to the main body, and in turn drive the first baffle to protrude above the upper surface of the main body to be locked into the locating groove; and a second elastic element provided between the second press plate and the main body to pivot the second press plate with respect to the main body, and in turn drive the second baffle to protrude above the upper surface of the main body to be locked into the locating groove.

2. The system of claim 1, wherein the first and second baffles are provided with a bevel plane.

3. The system of claim 2, wherein each of the first press plate and the second press plate is provided with a slide-proof surface.

4. The system of claim 3, wherein the first baffle and the first press plate form an L-shaped structure.

5. The system of claim 4, wherein the first and second elastic elements are spring plates.

6. The system of claim 1, further comprising a laser sight provided in the main body.

7. The system of claim 1, further comprising a light source provided in the main body.

* * * * *